US009135897B2

(12) United States Patent
McDonald et al.

(10) Patent No.: US 9,135,897 B2
(45) Date of Patent: Sep. 15, 2015

(54) MAGNETIC GUITAR PICK RING AND MATERIAL FOR USE THEREWITH

(71) Applicants: Iain Grant Kirk McDonald, Asheville, NC (US); Stuart Joseph Benjamin, Candler, NC (US)

(72) Inventors: Iain Grant Kirk McDonald, Asheville, NC (US); Stuart Joseph Benjamin, Candler, NC (US)

( * ) Notice: Subject to any disclaimer, the term of this patent is extended or adjusted under 35 U.S.C. 154(b) by 0 days.

(21) Appl. No.: 14/467,197

(22) Filed: Aug. 25, 2014

(65) Prior Publication Data

US 2015/0075352 A1 Mar. 19, 2015

Related U.S. Application Data

(60) Provisional application No. 61/869,253, filed on Aug. 23, 2013, provisional application No. 61/881,909, filed on Sep. 24, 2013.

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | | |
|---|---|---|---|---|---|
| 4,395,932 | A * | 8/1983 | Mills | 84/322 |
| 5,194,680 | A * | 3/1993 | Reineck | 84/320 |
| 5,483,859 | A * | 1/1996 | Singer | 84/322 |
| 6,118,058 | A * | 9/2000 | Rowley | 84/320 |
| 6,225,539 | B1 * | 5/2001 | Freeman | 84/322 |
| 6,344,021 | B1 * | 2/2002 | Juster et al. | 600/15 |
| 6,835,881 | B1 * | 12/2004 | Jackson | 84/322 |
| 6,846,977 | B2 * | 1/2005 | Oskorep | 84/322 |
| 6,933,430 | B2 * | 8/2005 | Oskorep | 84/322 |
| 6,977,330 | B2 * | 12/2005 | Santa Cruz et al. | 84/322 |
| 7,371,950 | B2 * | 5/2008 | Benyahia et al. | 84/320 |
| 7,799,979 | B2 * | 9/2010 | Swartz | 84/322 |
| 7,956,264 | B2 * | 6/2011 | Risolia | 84/322 |
| D694,811 | S * | 12/2013 | Houck, Jr. | D17/20 |
| 8,628,716 | B1 | 1/2014 | McPherson et al. | |
| 2002/0178891 | A1 * | 12/2002 | Atkin | 84/322 |
| 2004/0118265 | A1 * | 6/2004 | Katz | 84/322 |
| 2004/0237753 | A1 * | 12/2004 | Savage | 84/322 |
| 2005/0148809 | A1 * | 7/2005 | Delaney | 600/15 |
| 2009/0139384 | A1 * | 6/2009 | Bramucci | 84/322 |
| 2013/0081530 | A1 * | 4/2013 | Risolia et al. | 84/322 |
| 2013/0152763 | A1 * | 6/2013 | Aletto et al. | 84/329 |
| 2013/0319203 | A1 * | 12/2013 | Risolia | 84/322 |
| 2014/0197216 | A1 * | 7/2014 | Bortree | 224/267 |
| 2015/0075352 | A1 * | 3/2015 | McDonald et al. | 84/322 |

* cited by examiner

*Primary Examiner* — Robert W Horn

(57) ABSTRACT

An improved apparatus for retaining a guitar pick is provided, which includes a ring with a magnetic component being attached, by a chain for example, to a guitar pick also including a magnetic component. The apparatus allows a performer to release or drop the guitar pick, either intentionally or unintentionally, and have the guitar pick be maintained in the performer's hand by its attraction to the magnetic component of the ring. The guitar pick may be made from a magnetic material, including for example stainless steel or a magnetic plastic.

10 Claims, 2 Drawing Sheets

MAGNETIC GUITAR PICK RING AND MATERIAL FOR USE THEREWITH

CROSS-REFERENCE TO RELATED APPLICATIONS

This application claims the benefit of U.S. Provisional Application Nos. 61/869,253 and 61/881,909, filed Aug. 23, 2013 and Sep. 24, 2013, which are hereby incorporated by reference in their entirety.

FIELD OF THE INVENTION

The present invention relates to a new improvement and solution to the guitar player's traditional method of holding and using a pick and to a magnetic plastic, more particularly to a composition of iron and/or steel or other suitable ferromagnetic particles embedded or mixed in a polymer based plastic that can then be magnetized.

BACKGROUND OF THE INVENTION

Consistently holding standard plastic flat picks while playing a guitar has always been an issue facing guitar players. Guitar pick manufacturers have sought many solutions to this problem to no avail, including: making picks larger, making picks in different shapes, making picks with traction ridges on them, making picks chalky for grip, adding holes in the back of the pick for grip, or making picks with varying thicknesses and pliability. Some manufacturers have devised a spring loaded pick holder that holds up to ten picks and has an adhesive that sticks right to the edge of the guitar, so that when a pick falls out of the performer's hand, he or she can reach up and slide another pick out of the holder. However, the time that it takes the performer to grab another pick interferes with the execution of a song in its pre-set time signature. Some musicians will actually put the pick in between their teeth while they play a song so as not to lose the pick while utilizing all of their fingers for a more intricate style of finger picking.

A claw pick is used primarily, but not exclusively, for banjo picking. In the claw pick, the thumb has a stationary pick, smaller than standard size, worn around the thumb in a loop. The claw picks are also stationary, worn on the tips of all of the fingers, and are shaped like claws, resembling nothing like a flat pick.

The present invention solves these shortcomings in the art by providing a magnetic guitar pick ring.

In addition, there is a lack of materials in the art that can be magnetized yet have the feel of a plastic material. There are plastic products with magnets embedded into them later. There is even a "magnetic rubber" mixture used for signs that stick to vehicles and refrigerators. However, there is no material that is plastic itself being magnetic.

There are several reasons for this deficiency in the art. In order to have a magnetic material with the touch, feel, and the weight people are accustomed to in a plastic, metallic particles, preferably of the size of metallic dust, must be mixed into the plastic prior to injection molding of the article. The metallic particles must be mixed and distributed evenly throughout the plastic prior to charging the material. If one charges the particles before injection molding, and then adds the particles to the plastic, the heat required to melt the plastic will de-magnetize the tiny particles. Even if this method could be performed, the particles would attract and repel themselves into clumps in the plastic.

If the particles are non-magnetic prior to being mixed in, then they are completely insulated from one another by the plastic surrounding each particle. This means that the particles cannot be magnetized by an electric current because the particles do not touch each other. Therefore, the only other option would be to create a magnetic field around the plastic to charge the particles inside, but in this case, the particles would be locked in place in the hardened plastic, not allowing the poles to be aligned with any continuity or consistent magnetic flux. The present invention addresses these problems facing the art.

SUMMARY OF THE INVENTION

The present invention relates to a magnetic pick ring comprising a guitar pick attached to a ring by a chain, so that the performer can execute a seamless transition between using the pick and finger picking the strings of the guitar or other instrument. A small magnet is attached to a bezel housing on the ring. Either the pick or the coupling attaching the ring to the pick is made of a material having magnetic properties. The pick and/or coupling attached to the pick would then retract back to the magnet and be worn on the inside of the strumming hand, flush with the inside of the fingers.

A small hole can be bored into the back edge of a standard plastic pick allowing for a clasp or coupling to attach to the pick from the bored hole. The clasp that attaches the chain to the ring, and the chain itself, are made of non-magnetic material, so that the clasp and chain are not drawn back to the magnet. However, if the pick does not have magnetic properties, the clasp attached to the pick has magnetic properties. This allows the pick to be retracted back smoothly and not become tangled up on the ring. The ring can be formed from any appropriate material, such as gold, plastic or silver.

This invention accomplishes at least two practical applications. First, it allows musicians to play the guitar with a pick and never have the pick fall out of the musician's hand. If the pick is dropped, intentionally or inadvertently, the pick will be drawn to the magnet where it can be easily grasped by the performer when needed. Second, the present invention would allow a performer to use the pick and then seamlessly transition into finger picking, using all the fingers and thumb, by sliding the pick back to the magnet affixed to the ring. The ring can be worn on the thumb or any finger, excluding the pinky. The magnet side of the pick ring, including the pick and magnet, are worn on the inside or palm side of the hand so as to allow the performer to pull the pick back off the magnet using the other digits.

The present invention further contemplates a hard, lightweight and durable composition of basic substances that allows magnetic repulsion or adhesion with structural function which can be used in creating a pick having magnetic properties.

The present invention contemplates the method for making and using the magnetic plastic disclosed herein.

Having summarized the present invention herein, the invention will now be described in further detail in reference to the accompanying Figures.

DETAILED DESCRIPTION OF THE INVENTION

Figure 1:
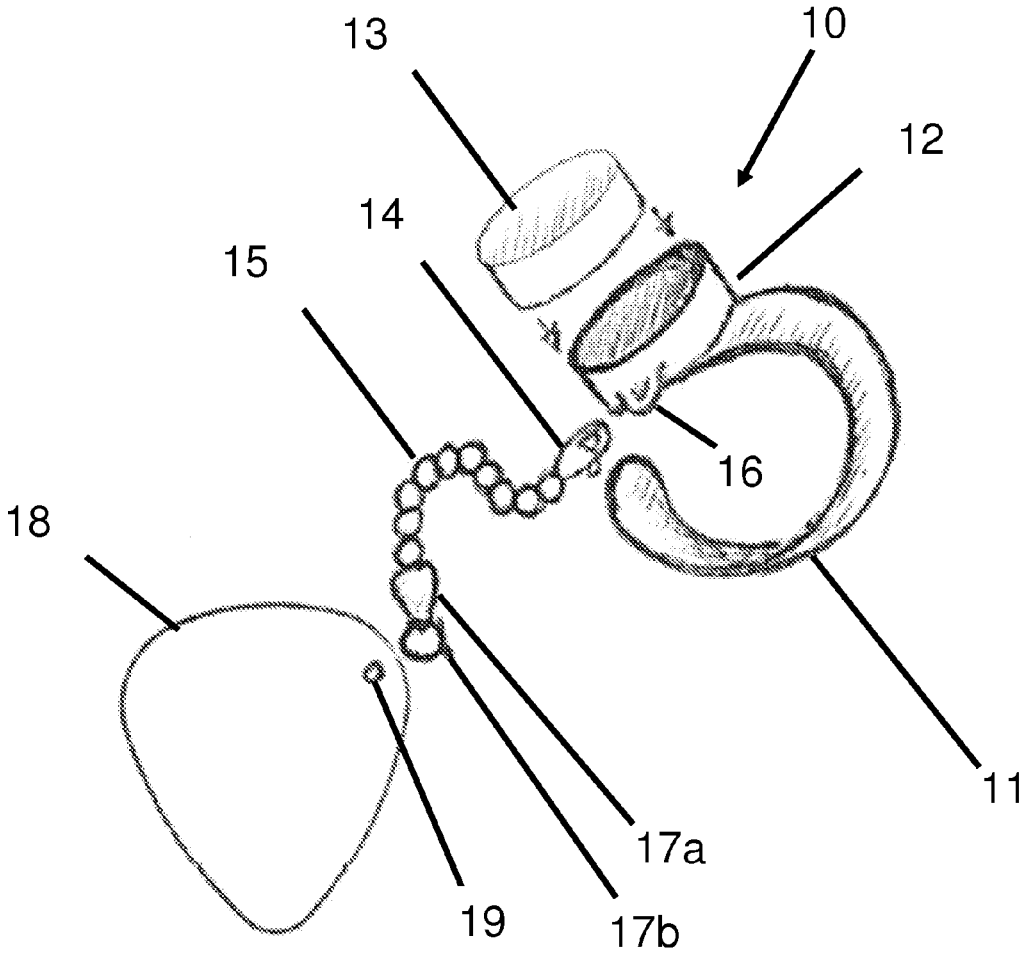
FIG. 1 illustrates the components of the magnetic pick ring according to an embodiment of the present invention.
Figure 2:
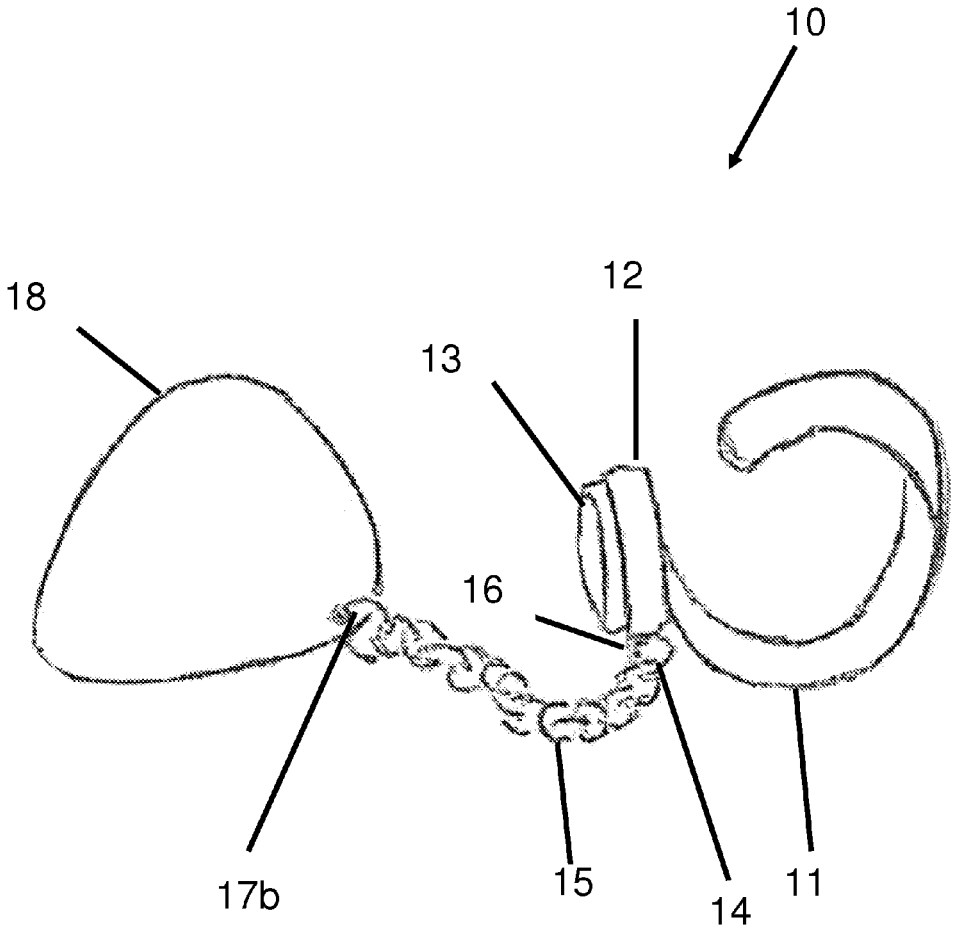
FIG. 2 illustrates the assembled magnetic pick ring according to an embodiment of the present invention.

The magnetic pick ring according to the present invention is described in reference to FIGS. 1 and 2.

The magnetic pick ring 10 includes a flexible ring or band 11 connected to or having a bezel housing 12 at the base of the ring 11. The bezel housing 12 comprises an opening to receive a magnet 13 of equal or lesser size. The magnet 13 is secured to the bezel housing 12 and ring 11 by soldering, gluing, or fitting the magnet 13 inside the bezel housing 12. A catch 16 is soldered to a side edge of the bezel housing 12 so that a clasp 14 can be secured to the ring 11. In a preferred embodiment, the clasp 14 is a lobster claw clasp, however, other suitable clasping means can be utilized.

A chain 15 is attached to the clasp 14 on one end of the chain 15. The opposing end of the chain 15 comprises a clasp 17*a* and collar 17*b*. In a preferred embodiment, the chain 15 has a length of approximately 1¼" to 1½".

On the end of the chain 15 opposing the ring 11, the chain 15 is secured to a guitar pick 18. If the guitar pick 18 is made from a magnetic material, the chain 15 may secure to the pick 18 by a riveted stud. Alternatively, the chain 15 can be attached to the guitar pick 18 by a spring ring clasp 17*a* with a stainless steel collar 17*b*, or by either of these components alone, which may be preferred if the pick 18 is made of a non-magnetic material. However, the present invention is not limited to these means for attaching the chain 15 to the pick 18. Another alternative would be to create two holes on each side of the pick 18 and have studs anchored to a small base plate and clamped with hinges to another small base plate with receivers clamped or clipped together. Alternatively, the pick 18 can be slid into a spring with teeth, like a vise grip or battery cables.

To use the magnetic pick ring 10, the ring 11 can be placed on the thumb or any finger except the pinky finger. The ring 11 is worn on the inside of the hand, so the magnet 13, bezel housing 12, and pick 18 are oriented on the inside palm of the strumming hand. As a result, when the pick 18 is stationary or trapped magnetically to the ring 11, the thumb or other digits are free to slide the pick 18 off of the ring 11 and bring the pick 18 to a comfortable playing position without creating too much tension on the chain 15.

The chain 15, which in a preferred embodiment has a length of approximately 1¼" to 1½", can be created in varying sizes to accommodate varying hand sizes. The clasps 14 and 17*a* allow easy removal of the chain 15 from the ring 11 and pick 18 to replace the chain 15 with alternate chains having different lengths. The chain 15 may also be substituted for another suitable means for attaching the ring 11 to the pick 18, such as a cord, string or rope, for example. Preferably, the ring 11 is not soldered together, but is open so as to be flexible to fit all sizes and thicknesses of the player's fingers. However, where preferred by the player, a pre-fitted or sized ring can be provided.

As a guitar player vigorously strums the instrument, he or she will not have to hold on to the pick 18 very tightly; thus allowing the wrist to be more limber, ultimately offering a more rhythmic approach to a given song. The pick 18 cannot be pulled out of the fingers due to added friction, however, should the player drop the pick 18 or the pick 18 falls from the player's fingers, a simple cupping of the wrist will bring the pick 18 back to the fingertips. If a guitar player chooses to free his fingers of the pick 18, the pick 18 can slide along the finger and the magnet 13 will secure the pick 18.

The ring 11, the clasp 14 and the chain 15 can be made of any relatively durable material. Preferably, the material does not have magnetic properties, so that the magnet 13 is free to pull either the magnetized pick 18 or the magnetized collar 17*b* back towards the ring 11. One material that can be used in creating the pick 18 and/or collar 17*b* is stainless steel because stainless steel has magnetic properties and is durable for use, allowing the pick 18 and/or collar 17*b* to be riveted to the chain 15 permanently. In addition, stainless steel will not rust and will retain its original aesthetics and luster. Alternatively, a magnetic plastic, as described below, can be used instead of stainless steel. The ring 11 and the bezel housing 12 can be made from gold, silver, plastic or any other suitable material. The clasp 14 and chain 15 can be made of aluminum, silver, or any other suitable material, preferably a material being durable enough for repeated use.

It is also envisioned that the composition of the pick can be a magnetic plastic material. This material includes magnetic particles inside of a plastic, thereby making the pick 18 magnetic with an opposite polarity to the ring 11.

Although stainless steel is suitable for use as the pick 18 as described above, certain guitar players may prefer the touch and feel of a standard plastic pick to which they are accustomed. To accommodate this, a self-hardening polymer plastic epoxy mixed with metal filings can be used as the material for the pick 18. The metallic particles are evenly dispersed and mixed inside the polymer material, which can be magnetized with a magnetic resonance imaging earth magnet machine or using any suitable means or apparatus now known or developed in the future.

In creating the magnetic plastic material, it is preferable to use smaller sized particles. This provides for more evenly dispersed and hidden particles within the plastic, so as to not be noticed by the naked eye. For example, the particles can be categorized into four grades of decreasing size: "shavings", "filings", "particles", and "dust".

In one embodiment, the magnetic plastic composition has a preferred ratio of metallic particle (such as iron or steel) to plastic material ranging from 10% metal and 90% plastic up to 33% metal and 67% plastic, by weight. Other ratios may be possible as determined by the properties of the metallic particles and plastic.

According to a second embodiment, another magnetic plastic composition and method for creating the composition are provided. A custom made tumbled barium ferrite dust that is in the shape of microscopic spheres, so as to not clog the injectors, is mixed with a plastic. The plastic to metallic particle ratio in the composition is sufficient to allow a gravity defying pull. Next, a device attaching two electrodes is embedded into the bottom of the steel die cast so when the plastic mixture is injected into the mold, a machine attached to the electrodes with the specific amperage needed is briefly turned on while the plastic is cooling but still in a semi-viscous state, thus allows the aligning of all the poles of all the individual particles in the plastic into a non-contradictory arc. Alternatively, a tumbled neodymium (NdFeB) powder no bigger than 3 microns could be used as the metallic particle.

According to an alternative method for creating the composition, a two piece die cast machine tool made of steel is provided and then both pieces are permanently magnetized, north to north and south to south. The two pieces are clamped together, as they would naturally repel each other. The plastic is then injected with the particles and into the mold creating all the poles to line up, yet not forcing the particles inside to be compressed into the center but brought and dispersed evenly to the very edges while simultaneously lowering the temperature and freezing the tool itself with liquid nitrogen, so the particles inside would lock themselves quicker into the hardening plastic and not be pulled all the way to one side too fast.

The magnetic plastic material according to this invention can be used in other products beyond the pick 18 according to this invention. For example, the magnetic plastic can be used in everyday household products, such as bottles, and even be used in mechanical engineering of lightweight magnetically charged components or tools and in any other technological fields.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed:

1. An apparatus comprising:

a ring comprising a magnet;

an instrument pick, at least a portion of which is magnetic and attracted to the magnet, and a chain comprising a first end comprising a first clasp to removably attach the chain to the instrument pick;

wherein the instrument pick comprises a collar inserted through a bore hole in the instrument pick and removably attached to the first clasp; and wherein the instrument pick is made from a plastic material and the collar is made from a magnetic material.

2. The apparatus of claim 1, wherein the ring further comprises a bezel housing and the magnet is configured to be secured in the bezel housing of the ring.

3. The apparatus of claim 2, wherein the bezel housing comprises a catch configured to receive a portion of the chain to attach the chain to the ring.

4. The apparatus of claim 3, wherein a second end of the chain comprises a second clasp configured to removably attach to the catch of the bezel housing.

5. The apparatus of claim 1, wherein the ring includes an opening and is not soldered closed.

6. The apparatus of claim 5, wherein the ring is made of a flexible material to accommodate more than one finger size.

7. The apparatus of claim 1, wherein the instrument pick further comprises magnetic metallic particles mixed with the plastic material.

8. The apparatus of claim 7, wherein the magnetic metallic particles include barium ferrite particles.

9. The apparatus of claim 8, wherein the barium ferrite particles are form microscopic spheres and are mixed with the plastic material such that the magnetic poles of the barium ferrite particles are aligned while the plastic is cooling.

10. The apparatus of claim 1, wherein the ring is configured to be worn on the finger of a user and is configured to attract the instrument pick when the instrument pick is released by the user and secure the instrument pick to the magnet, where the instrument pick can be retrieved by the user.

* * * * *